US005199611A

United States Patent [19]

Santefort et al.

[11] Patent Number: 5,199,611

[45] Date of Patent: Apr. 6, 1993

[54] APPARATUS FOR SQUEEZING MATERIAL FROM COLLAPSIBLE TUBES

[75] Inventors: Richard A. Santefort, Hamilton; Ray H. Haerr, Batavia, both of Ohio

[73] Assignee: Valco Cincinnati, Inc., Cincinnati, Ohio

[21] Appl. No.: 772,840

[22] Filed: Oct. 8, 1991

[51] Int. Cl.[5] ..... B65D 35/28

[52] U.S. Cl. ..... 222/103; 222/95; 222/325

[58] Field of Search ..... 222/95, 103, 325

[56] References Cited

U.S. PATENT DOCUMENTS

| | | | |
|---|---|---|---|
| 1,166,643 | 1/1916 | Wayne | 222/100 X |
| 1,207,534 | 12/1916 | Gammeter | 222/102 |
| 1,677,603 | 7/1928 | Steen | 222/95 |
| 1,959,365 | 5/1934 | Jeffreys | 221/60 |
| 2,357,351 | 9/1944 | Oliver | 222/102 |
| 2,551,909 | 5/1951 | Soileau | 222/100 |
| 2,723,050 | 11/1955 | Montgomery et al. | 222/103 |
| 2,766,907 | 10/1956 | Wallace, Jr. | 222/94 |
| 2,772,028 | 11/1956 | Lopez | 222/95 |
| 2,833,444 | 5/1958 | Sherbondy | 222/95 |
| 2,905,560 | 9/1959 | Bender et al. | 99/151 |
| 2,936,097 | 5/1960 | Loria et al. | 222/79 |
| 3,221,940 | 12/1965 | Watson, Jr. | 222/96 |
| 3,249,258 | 5/1966 | Kramer et al. | 222/102 |
| 3,282,473 | 11/1966 | Moore | 222/327 |
| 3,303,836 | 3/1967 | Joines | 132/861 |
| 3,481,510 | 12/1969 | Allen, Jr. | 222/79 |
| 3,593,885 | 7/1971 | Wiggins | 222/104 |
| 3,871,553 | 3/1975 | Steinberg | 222/95 |
| 3,933,273 | 1/1976 | Cox | 222/1 |
| 3,945,534 | 3/1976 | Ady | 222/105 |
| 3,961,727 | 6/1976 | Spears | 222/103 |
| 3,993,220 | 11/1976 | Troy | 222/82 |
| 4,008,830 | 2/1977 | Meshberg | 222/95 |
| 4,019,656 | 4/1977 | Spears | 222/103 |
| 4,270,672 | 6/1981 | Kraals | 222/95 |
| 4,375,864 | 3/1983 | Savage | 222/81 |
| 4,381,846 | 5/1983 | Heck | 222/105 |
| 4,405,062 | 9/1983 | Tschida, Sr. | 222/102 |
| 4,502,613 | 3/1985 | Yamamoto | 222/103 |
| 4,515,293 | 5/1985 | Hill et al. | 222/95 |
| 4,565,303 | 1/1986 | Gilbertson | 222/103 |
| 4,627,554 | 12/1986 | Leibinsohn | 222/103 |
| 4,711,373 | 12/1987 | Christine | 222/82 |
| 4,909,416 | 3/1990 | Evezich | 222/95 |
| 4,998,654 | 3/1991 | Pearson | 222/98 |
| 5,000,350 | 3/1991 | Thomsen | 222/103 |
| 5,012,956 | 5/1991 | Stoody | 222/94 |
| 5,035,347 | 7/1991 | Trovo | 222/95 |

FOREIGN PATENT DOCUMENTS

| | | | |
|---|---|---|---|
| 223438 | 10/1958 | Austria | 222/103 |
| 3627701 | 5/1987 | Fed. Rep. of Germany | 222/103 |

*Primary Examiner*—Andres Kashnikow
*Assistant Examiner*—Joseph A. Kaufman
*Attorney, Agent, or Firm*—Frost & Jacobs

[57] ABSTRACT

A collapsible tube dispenser is disclosed for use with collapsible tubes that contain highly viscous materials, such as silicone gasket RTV. The dispenser provides two engaging plates for squeezing the sides of a collapsible tube, which causes the contents of the tube to be expressed from its open end. The dispenser also includes two handles which can be gripped by a single hand of a human user. When the handles are kept apart from one another, a collapsible tube can be inserted into the gap formed between the engaging plates of the dispenser. When the handles are squeezed together, the engaging plates apply force to the sides of the tube, thus squeezing out a very controlled amount of highly viscous material. The dispenser is very easy to use, in that it can produce a bead of highly viscous material upon a target having a very narrow line width, and having great positional accuracy.

13 Claims, 4 Drawing Sheets

APPARATUS FOR SQUEEZING MATERIAL FROM COLLAPSIBLE TUBES

TECHNICAL FIELD

The present invention relates generally to dispensers useable with collapsible tubes and is particularly directed to dispensers which can be used with collapsible tubes containing highly viscous fluids of the type which have a nozzle tip of decreasing diameter that is attachable to the outlet port of the collapsible tube. The invention will be specifically disclosed in connection with collapsible tubes which are used to dispense silicone gasket material and have a crimped, closed end along with an opposing threaded, open end.

BACKGROUND OF THE INVENTION

Collapsible dispensing tubes containing fluids have been known in the art for many years. Certain collapsible tubes are used with a nozzle tip of decreasing diameter that is attachable to the outlet port of the collapsible tube, so that the highly viscous material being dispensed from the tube can be presented at a customer-determined width onto the target surface. For a person to use the decreasing diameter nozzle, he must cut the nozzle near its tip at a location along its decreasing diameter that will provide a bead of highly viscous material of desired diameter as the material is being dispensed.

It is frequently desirable to dispense certain highly viscous materials, such as silicone gasket sealant, in a bead having a very narrow line width Collapsible tubes which contain highly viscous materials such as silicone gasket sealant are difficult to use when the person squeezing the tube is using his bare hands to dispense the material in a uniform bead, especially if the line width of the bead is to be narrow. The more narrow the width of the bead, the more force is required to push the material out of the collapsible tube. If the bead is to be of such narrowness as to be useful for many applications, then the force that is required to push the material out of the tube will be so great that the dispensing of the highly viscous material becomes almost uncontrollable, and makes it very likely that the bead produced will not be straight.

An additional problem in dispensing highly viscous material from collapsible tubes is that it is very difficult to squeeze all of the contents from the tube when using only bare hands; in fact, it is virtually impossible. Because of the difficulties in using material-containing collapsible tubes, and because of the popularity of such tubes regardless of the difficulties in their use, the prior art has attempted to solve the above problems in dispensing highly viscous material from such tubes in various ways.

One popular method in the prior art of dispensing material from collapsible tubes (or collapsible bags) is the use of rollers which squeeze the tube from the crimped, closed end toward the open end of the tube, thereby causing such material to be forced out of the tube. Examples of such prior art are U.S. Patent Nos. 1,207,534 (by Gammeter), 2,357,351 (by Oliver), 3,221,940 (by Watson), 3,249,258 (by Kramer), 4,405,062 (by Tschida), and 4,998,645 (by Pearson). Such devices have the general configuration wherein the collapsible tube is placed inside a rigid container, and a portion of the tube is placed between a pair of rollers which are spaced-apart, and parallel to one another. The above patents disclose various methods of either sliding the collapsible tube toward the rollers, or sliding the rollers toward the open end of the collapsible tube, but in all cases, require some type of internal moving parts (the rollers and/or the sliding mechanism) which create a more complex and expensive apparatus than desired.

Another popular method in the prior art of dispensing material from collapsible tubes (or collapsible bags) is the use of either a piston or a plunger to squeeze the tube from the crimped, closed end toward the open end of the tube, thereby causing the material to be forced out of the tube. Examples of such prior art are U.S. Pat. Nos. 1,677,603 (by Steen), 2,772,028 (by Lopez), 2,833,444 (by Sherbondy), 3,308,836 (by Joines), 3,933,273 (by Cox), 4,515,293 (by Hill), 4,711,373 (by Christine), and 5,035,347 (by Trovo). Such devices have the general configuration wherein the collapsible tube is placed inside a rigid container, and a piston or a plunger is pushed against the tube (or collapsible bag), thereby squeezing the tube from the crimped, closed end toward the open end of the tube, causing such material to be forced out of the tube. The above patents all disclose devices which require some type of internal moving parts (i.e., the piston or the plunger, usually having an associated spring of some type), and are unnecessarily complex and expensive.

Another method for dispensing material from collapsible tubes in the prior art is the use of a pressure plate to squeeze the tube, wherein the pressure plate is actuated by a trigger of a dispensing gun. Examples of such prior art are U.S. Pat. Nos. 2,936,097 (by Loria), and 3,481,510 (by Allen). These patents, again, disclose devices which require some type of internal moving parts.

A further method for dispensing material from collapsible tubes in the prior art is the use of a key which is turned, thereby rolling the tube from its crimped, closed end around the key. The act of rolling the tube around the key compresses the tube, and forces its contents to be expressed. Examples of such prior art are U.S. Pat. Nos. 1,166,643 (by Wayne), and 2,551,909 (by Soileau). The apparatus that implements this method is simple; however, the bead produced by turning the key is not precise for the reason that it is difficult to hold a steady aim (for placement of the bead upon the target) while, at the same time, turning the key.

A yet further method for dispensing material from collapsible tubes in the prior art is the use of a twisting cap which, while being turned, twists the closed end of the tube. The act of twisting the tube's closed end, while the open end of the tube is held stationary, forces the tube's contents to be expressed. Examples of such prior art are U.S. Pat. Nos. 1,959,365 (by Jeffreys), and 3,593,885 (by Wiggins, et al.). The apparatus that implements this method also is simple; however, the bead produced by turning the end cap is not precise for the reason that it is difficult to hold a steady aim (for placement of the bead upon the target) while, at the same time, twisting the end cap of the apparatus. From this standpoint, this method is similar to the use of a key to roll up the tube from its closed end, discussed above.

A still further method for dispensing material from collapsible tubes (or collapsible bags) in the prior art is the use of compressed air to apply force to either the sides or the crimped, closed end of the tube (or the closed end of the bag), thereby forcing the tube's (or bag's) contents to be expressed. Examples of such prior art are U.S. Pat. Nos. 2,766,907 (by Wallace), 3,282,473 (by Moore), 3,871,553 (by Steinberg), 3,945,534 (by Ady), 4,909,416 (by Evezich), and 5,012,956 (by Stoody). Devices that implement this method either use the human hand to produce the pressure that collapses the tube, or require a compressed air source for the same purpose. It is obvious that compressed air, rather than hand-squeezing, would be required in order to gain a sufficient mechanical advantage to make it easier to squeeze a tube that had an outlet port of small diameter, in order to produce a bead having a small width.

Another method for dispensing material from collapsible tubes (or collapsible bags) in the prior art is the use of solid plates which apply force to both sides of the tube (or bag), thereby forcing the tube's contents to be expressed. Examples of such prior art are U.S. Pat. Nos. 4,502,613 (by Yamamoto), 4,565,303 (by Gilbertson), and 4,627,554 (by Leibinsohn). The Leibinsohn device consists of two elastic plates (which are flexible yet strong enough to apply force to the collapsible container) that are hinged together, and have a collapsible container filled with liquid that is placed between the elastic plates. The plates can be closed over the collapsible container, thus exerting a continuous force to the container and forcing liquid out of the container. It is specifically designed to dispense an infusion liquid at a substantially constant pressure.

The Yamamoto apparatus includes hinged top and bottom covers that close over the collapsible tube at two slot locations, and which tend to squeeze the contents from the tube due to the force exerted by the narrowed slots against the sides of the tube. Once the covers are closed, a pivotable lever can be rotated to compress a portion of the tube and to lock the tube in place. To dispense further material from the tube, the tube is drawn through the slots in the closed covers, thereby squeezing further contents from the tube, and also tending to rotate the pivotable lever into its unlocked position. Once the tube is properly repositioned, the pivotable lever can be again rotated into its locking position. It is obvious that the operation of drawing the collapsible tube through the slots in the closed covers would be difficult to manually perform, especially in the case of a tube that had an outlet port of small diameter (and thus requires a large effort to squeeze out any material). In addition, the bead produced while attempting to draw the tube through the closed covers' slots would neither be in a straight line nor would have a uniform line width, because the pressure exerted against the tube would be virtually uncontrollable while the tube was being so drawn.

The Gilbertson apparatus consists of a base member and a pivotable, removable cover. The cover is removed in order to insert a collapsible tube into the apparatus, then the cover is returned to its normal position, thereby locking the tube in place between the base and the cover. Once this is accomplished, the base and cover are manually squeezed together, thereby causing the contents of the tube to be expressed. The base and cover engage the tube along a substantial portion of the length of the tube, and tend to collapse the tube progressively from the closed, rearward end toward the open, forward end, thus minimizing the amount of wasted material that remains in the tube.

As can be seen, above, the prior art utilizes devices of relative complexity in order to dispense highly viscous material from collapsible tubes. Only a few of the prior art devices are both simple in construction (having no rollers or pistons, for example), and easy enough to use so that hand-squeezing force alone is sufficient to express the contents of such collapsible tubes.

SUMMARY OF THE INVENTION

Accordingly, it is a primary object of the present invention to provide a collapsible tube dispenser, which is simple in construction and also easy to use by hand, so that a straight bead of highly viscous material having narrow width can be Produced upon a target surface.

Another object of the present invention is to provide a collapsible tube dispenser which can be operated with only one hand, and can easily be aimed so that the bead produced by the expressed contents of the tube is placed upon the desired target surface.

A further object of the present invention is to provide a collapsible tube dispenser having a gap which has a varying width in order to allow different portions of the collapsible tube to be engaged by the dispenser. The gap can also be used to engage and retain the crimped, closed end of a collapsible tube, in order to lock the tube in place once it is properly positioned within the dispenser.

Additional objects, advantages and other novel features of the invention will be set forth in the description that follows and will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved collapsible tube dispenser is disclosed having simple two-piece construction, wherein each of the two pieces includes a handle that is easily gripped by the hand of the user, so that, after a collapsible tube is positioned between the engaging plates of the dispenser, the user can express highly viscous material from the outlet of the tube by using a single hand to squeeze together the handles of the two pieces of the dispenser. The crimped, closed end of the collapsible tube is placed through a gap formed between the two engaging plates of the dispenser, after which the tube is locked into place within the gap by gently squeezing the two handles together, which positions the engaging plates such that the crimped, closed end cannot come back through the gap. Once the collapsible tube is positioned within the gap, the handles can be used to squeeze the tube from the rearmost portion of the tube toward the forward-most portion, and the handles can also be further squeezed to the point where the engaging plates leave very little space between them, wherein the highly viscous material is almost entirely expressed from that portion of the tube. After a particular portion of the collapsible tube has been entirely evacuated, the handles can be released so as to allow the gap to open to its maximum distance, and the tube can be slid rearward, thus allowing the engaging plates of the dispenser to engage an unused portion of the collapsible tube for the dispensing of further highly viscous material.

Still other objects of the present invention will become apparent to those skilled in this art from the following description wherein there is shown and described a preferred embodiment of this invention, simply by way of illustration, of the best modes contemplated for carrying out the invention. As will be realized, the invention is capable of other different embodiments, and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention, and together with the description serves to explain the principles of the invention. In the drawing.

DETAILED DESCRIPTION OF THE PREFERRED EMBODIMENT

Reference will now be made in detail to the present preferred embodiment of the invention, an example of which is illustrated in the accompanying drawing, wherein like numerals indicate the same elements throughout the views.

Figure 1:
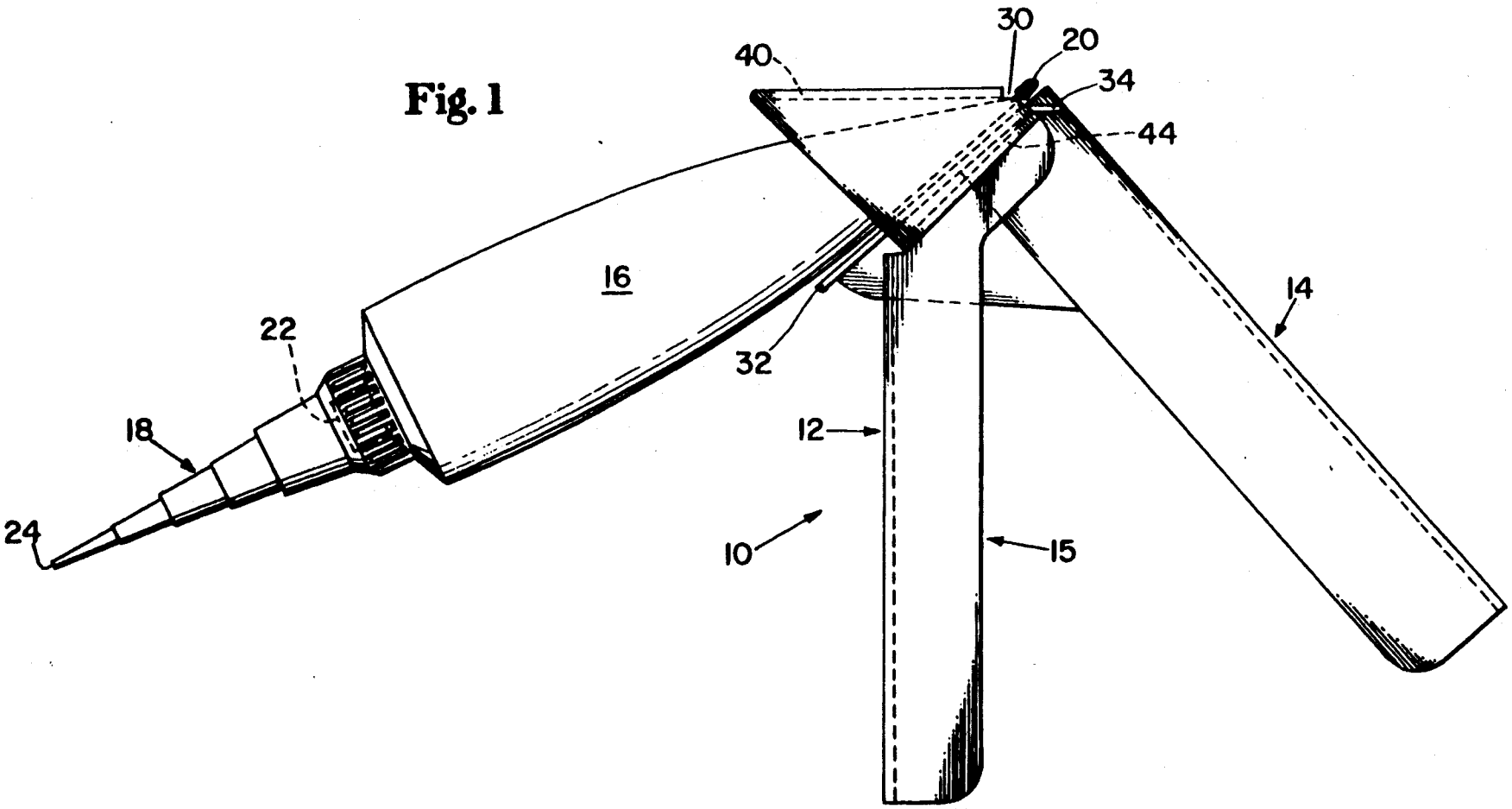
FIG. 1 is a side elevational view of a collapsible tube dispenser assembly built in accordance with the present invention in cooperation with a collapsible tube which is substantially filled with highly viscous material.

Referring now to the drawing, FIG. 1 shows a collapsible tube dispenser apparatus, generally denominated by the numeral 10, which has the capability of squeezing a collapsible tube, which may be constructed of flexible metal or plastic as is well understood in the art, denominated by the numeral 16. In the illustrated embodiment of FIG. 1, collapsible tube dispenser 10 consists of two major pieces, a front handle member 12 and a rear handle member 14. In the illustrated embodiment, the front and rear handle members, 12 and 14 respectively, are made of steel, and have welded construction. It is obvious to one of ordinary skill in the art that the handle members 12 and 14 can be made of any solid material which is strong enough to perform the necessary task of squeezing the collapsible tube 16, including molded plastic. In FIG. 1, the handle members have not yet been squeezed together to express the highly viscous fluid material from the collapsible tube 16.

The lower portion of front handle member 12 comprises a channel-shaped manually graspable handle 12*a*. The upper part of front handle member 12 has a generally planar engaging plate 40 the surface of which is configured to abut and press against a portion of the upper surface collapsible tube 16 adjacent the crimped end 20 of the tube 16. The lower part of rear handle member 14 forms a channel-shaped manually graspable handle 14*a*. The upper part of rear handle member 14 also has an engaging plate 32 the upper surface of which is configured to abut and press against a portion of the lower surface of collapsible tube 16 adjacent crimped end 20 of the tube 16. When the uppermost ends of handle members 12 and 14 are nested together as shown in FIG. 1, a gap 30 is formed between the engaging plates 40 and 32, so as to allow the rearmost portion of the collapsible tube 16 to extend through the gap 30. In particular, the crimped end 20 of collapsible tube 16 must be able to fit through the gap 30, so that the tube is positioned between the engaging plates 32 and 40.

The typical collapsible tube 16 shown in FIG. 1 may contain any one of a number of fluids, particularly those used for forming seals or gaskets, e.g., silicone gasket material, such as black RTV material. As is well known in the art, this class of sealants is highly viscous at room temperature. A collapsible tube of sealant typically comes with a decreasing diameter plastic nozzle tip, designated by the numeral 18, which allows a person to dispense the formable silicone gasket material in a user-chosen bead diameter, depending on the opening size in the tip. In order to use the decreasing diameter nozzle 18, it must be attached to the open end 22 of collapsible tube 16, as shown in FIG. 1. A typical method of such attachment is by means of screw threads—external threads on the opened end 22 of the collapsible tube 16, and internal threads on the larger diameter end of decreasing diameter nozzle 18, as is well known in the art.

Figure 2:
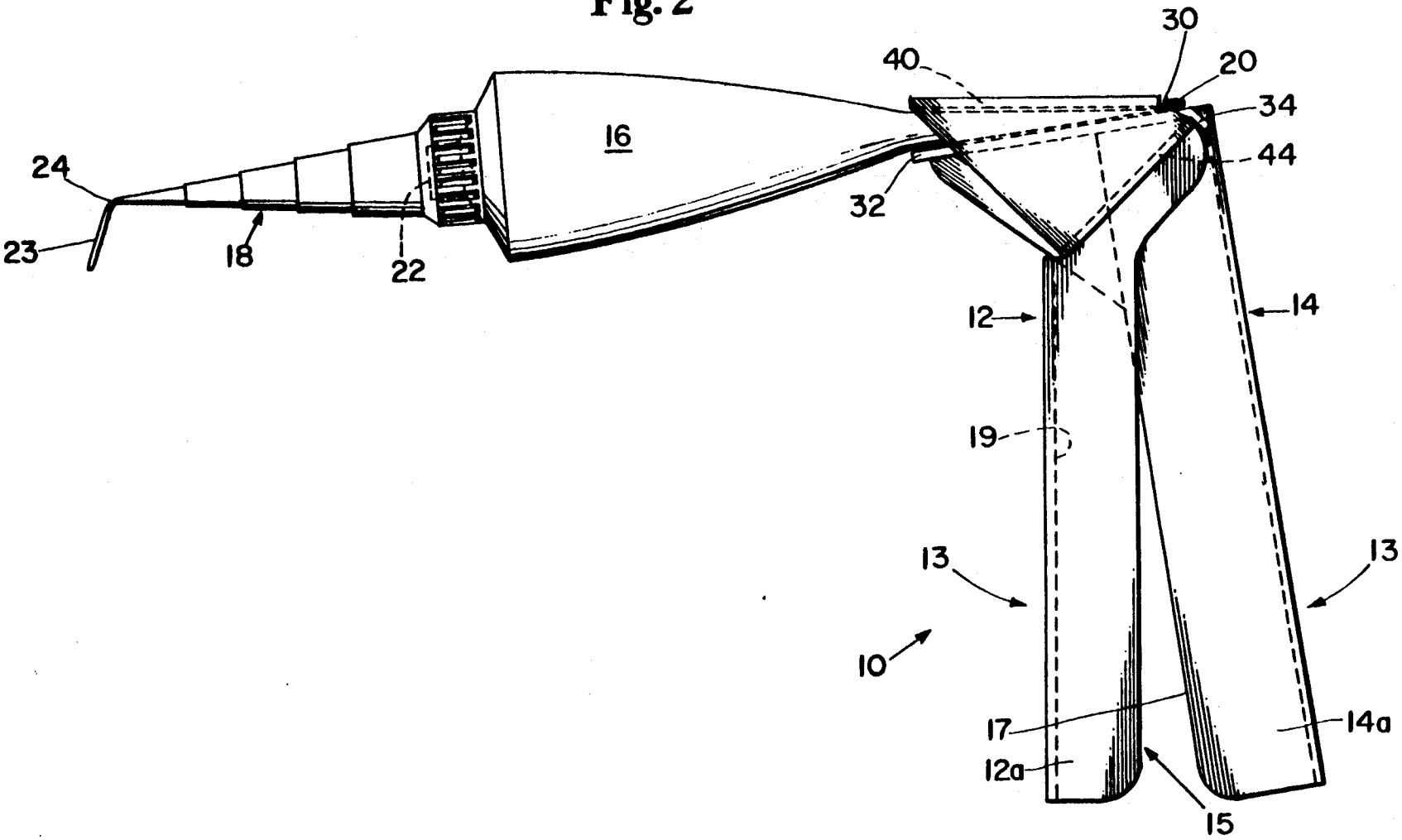
FIG. 2 is a side elevational view of the collapsible tube dispenser assembly of FIG. 1, depicting the collapsible tube after a portion of its highly viscous material has been dispensed.

FIG. 2 shows the collapsible tube dispenser apparatus 10 after it has been actuated by the user by squeezing the handles 12*a* and 14*a* together in the directions shown by arrows 13, to begin expressing a thin bead 23 of fluid material through the open tip 4 of nozzle 18. As can be seen in FIG. 2, when handles 12*a* and 14*a* are squeezed together, engaging plates 32 and 40 are positioned much closer to one another, thus making the gap 30 smaller than before. Gap 30, however, is still large enough in size to allow the tube to remain within the gap 30, and particularly locks in the crimped end 20 of collapsible tube 16 in position so that it cannot slip out of the dispenser apparatus 10. As shown in FIG. 2 collapsible tube 16 has had its rearmost portion flattened to a certain degree, and thus has had some of its highly viscous material dispensed through the open tip 23 of decreasing diameter nozzle 18.

Front handle 12*a* is channel-shaped, having its open side 15 toward the rear (toward the right in FIG. 2). The open side 15 is large enough in width so as to allow the width of rear handle 14*a* to fit entirely within the open channel space (at 15 in FIG. 2) of front handle 12*a*. The two handles 12*a* and 14*a* can, thus, be squeezed entirely together until the proximal (with respect to front handle 12*a*) longitudinal edge 17 of handle 14*a* comes into contact against the distal (with respect to rear handle 14*a*) closed longitudinal side 19 (which runs vertically in FIG. 2) of handle 12*a*.

Front handle member 12 is made with a large enough opening near the gap 30 so that rear handle member 14 can easily be removed altogether from engagement with front handle member 12. The configurations shown in FIGS. 1 and 2 demonstrate that a collapsible tube 16 can easily be inserted into the dispenser apparatus 10 when the front and rear handle members, 12 and 14 respectively, are positioned such that the gap 30 is at its maximum opening distance. This will occur when the handle members 12 and 14 are positioned as shown in FIG. 1. To use the dispenser apparatus 10, the crimped end 20 of collapsible tube 16 is inserted through the gap 30, and then the rear handle member 14 is moved forward, toward the front handle member 12, until the collapsible tube 16 is firmly held in place by the engaging plates 32 and 40. Once in this position, collapsible tube 16 is locked into position, because its crimped end 20 cannot slip out of the gap 30. In addition, once in this position, handles 12*a* and 14*a* are near enough in proximity to one another so that a single hand can be used to further squeeze together the handles and apply enough force on the sides of collapsible tube 16 to force some of its highly viscous material contents out through decreasing diameter nozzle 18.

Collapsible tube dispenser apparatus 10 is very easy to use in that it is extremely controllable as to how much material is to be dispensed at any given time. Even a very small diameter opening in tip 24 of the decreasing diameter nozzle 18 can be used for dispensing a bead of highly viscous material. Where the gasket material is to be dispensed in a very thin line, the user of collapsible tube dispenser apparatus 10 can merely lay the tip 24 of decreasing diameter nozzle 18 directly onto the target surface, then start squeezing handles 12*a* and 14*a* together slowly, and controllably, while slowly moving the tip 24 along the surface of the target in a manner so as to produce a very straight line, if desired, of gasket material. Once the material is virtually completely expressed from a given portion of collapsible tube 16, for example as seen in FIG. 2 for the rearmost portion of collapsible tube 16, then the handles 12*a* and 14*a* can be pivoted apart from one another, thus opening up gap 30 to a larger extent. At that point, collapsible tube 16 can be slid rearwardly (toward the right in FIG. 2), so as to position a new portion of the tube 16 still containing fluid material between engaging plates 32 and 40. Front handles 12*a* and 14*a* are squeezed together until engaging plates 32 and 40 make contact with the upper and lower surfaces of collapsible tube 16.

By gradually squeezing all of the highly viscous material out of the portion of collapsible tube 16 positioned between the engaging plates 32 and 40, and then by sliding collapsible tube 16 rearwardly so as to bring an unused portion of the tube 16 between the engaging plates virtually all of the tube 16 can be successively flattened to express practically all of the fluid material out from the collapsible tube 16. In some applications, it may also be advantageous to position a smaller portion of collapsible tube 16 between the engaging plates 32 and 40 as compared to the amount of the tube 16 being flattened in FIG. 2. There may be applications where this approach is desirable in order to maintain a little more control over the dispensing rate of the highly viscous material.

It will be understood that silicone gasket material is not the only material that can be used with the collapsible tube dispenser apparatus of the present invention. Other uses include, but are not limited to, cake or pastry icing, or temporary dental filling material.

Figure 3:
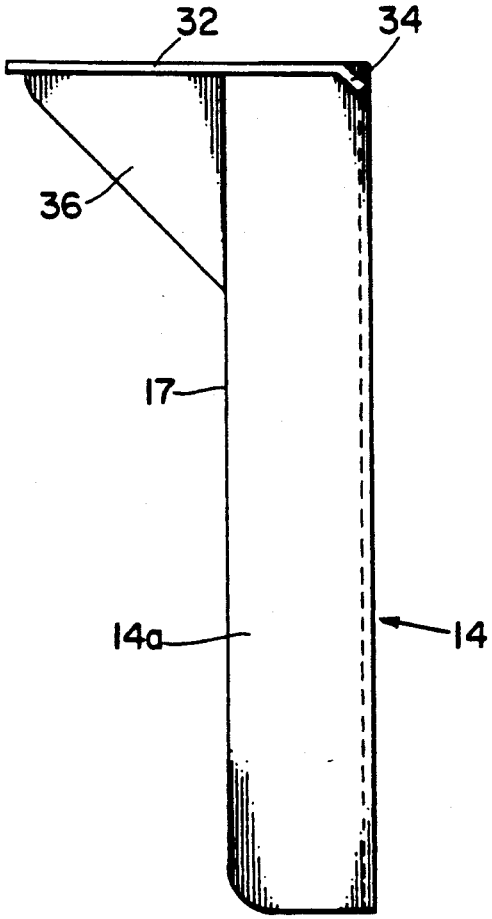
FIG. 3 is a side elevational view of the rear handle member used in the collapsible tube dispenser apparatus of FIG. 1.
Figure 4:
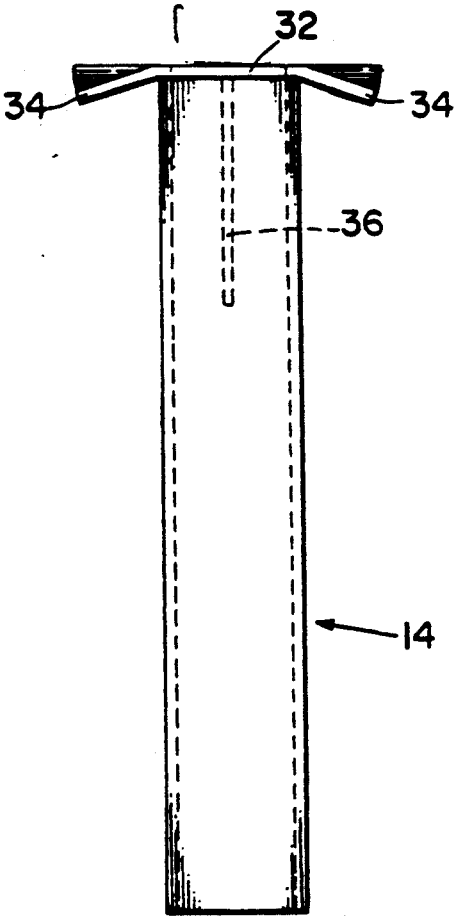
FIG. 4 is a front elevational view of the rear handle member used in the collapsible tube dispenser apparatus of FIG. 1.
Figure 5:
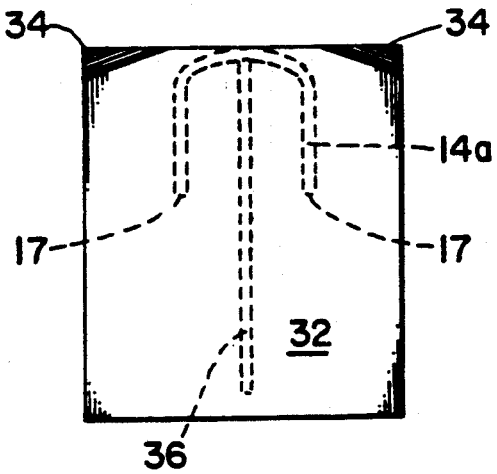
FIG. 5 is a top plan view of the rear handle member of the collapsible tube dispenser apparatus of FIG. 1.

FIGS 3, 4, and 5 show some of the construction details of rear handle member 14. Rear handle member 14 comprises an elongated, channel-shaped handle 14*a* surmounted by engaging plate 32. A gusset 36 connects handle 14*a* and plate 32 to provide structural integrity. The rearmost corners of engaging plate 32 are bent downwardly, as shown at 34. In the illustrated embodiment, engaging plate 32, gusset 36, and handle 14*a* are all made of a suitable metal and are welded together to make the rear handle member 14. The entire rear handle member 14 could also be made in one piece of molded plastic or from appropriately bent sheet metal.

The downwardly bent corners 34 of engaging plate 32 are shaped so as to limit the travel of rear handle member 14 with respect to the front handle member 12. As can be seen in FIGS 1 and 2, downwardly bent corners 34 are located in close proximity to the rearmost portion (to the far right on FIGS 1 and 2) of base support 44, described hereinafter, which is part of front handle member 12. In the configuration of FIG. 1, bent corners 34 tend to keep rear handle member 14 properly positioned, so that the gap 30 between engaging plates 32 and 40 is at a maximum distance (useful for loading an unused portion of collapsible tube 16 into the area between the engaging plates). In the configuration of FIG. 2, bent corners 34 tend to keep rear handle member 14 properly positioned with respect to front handle member 12, thus providing a "nesting" effect such that handle members 12 and 14 cooperate with each other so that the squeezing operation of a collapsible tube 16 is easily performed.

Figure 6:
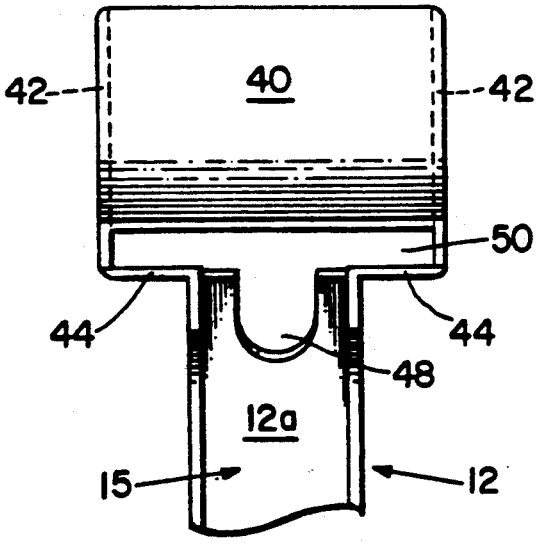
FIG. 6 is a fragmentary rear oblique view of the front handle member of the collapsible tube dispenser assembly of FIG. 1. The view is taken along the angle of the base support for the front handle member engaging plate.
Figure 7:
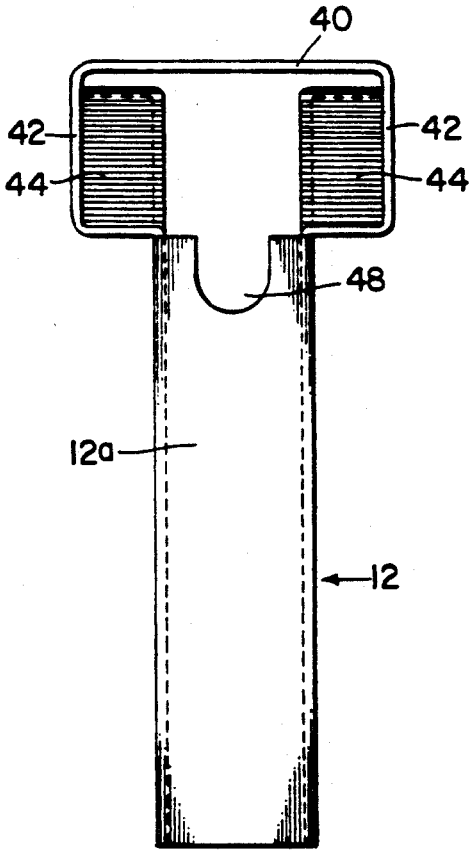
FIG. 7 is a front elevational view of the front handle member of the collapsible tube dispenser apparatus of FIG. 1.
Figure 8:
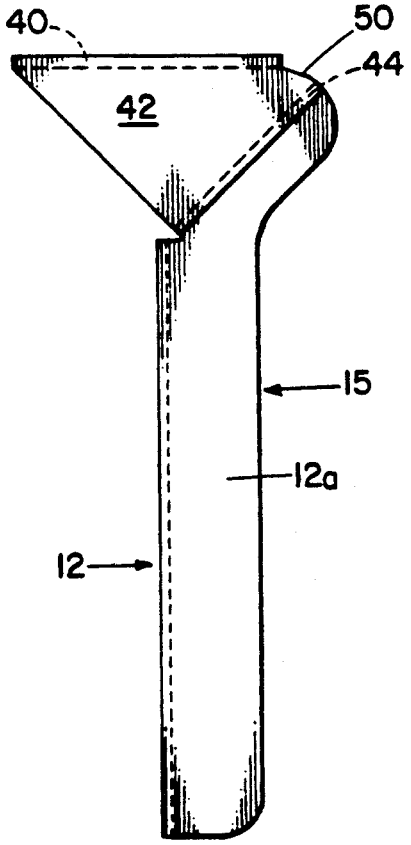
FIG. 8 is a side elevational view of the front handle member of the collapsible tube dispenser apparatus of FIG. 1.

FIG. 6 through 8 show the details of the front handle member 12 construction. Front handle member 12 comprises an elongated, channel-shaped handle 12*a*, surmounted by engaging plate 40. A pair of triangular-shaped vertical supports 42 connect the sides of engaging plate 40 to the upper end of handle 12*a*. A pair of base supports 44 are formed in the upper portion of front handle 12*a*, which connect to and provide structural support for the vertical supports 42. The handle 12*a* has a rounded notch 48 adjacent its upper end, to allow clearance for the rear handle member's gusset 36 as handles 12*a* and 14*a* are opened apart. A slot 50 is formed between the rearmost edge of engaging plate 40 and the upper surfaces of base support 44 to allow clearance for the engaging plate 32 of rear handle member 14. Slot 50 is best viewed in FIG. 6.

Slot 50 is formed in front handle member 12 so that its shape will accommodate the insertion and removal of rear handle member 14. Slot 50 is wide enough to allow the width of engaging plate 32 of rear handle member 14 to easily pass through, and also is high enough to allow the thickness of engaging plate 32 of rear handle member to easily pass through. The engaging plate 32 of rear handle member 14 can be inserted through slot 50 until the downwardly bent corners 34 of the engaging plate 32 of rear handle member 14 come to rest against the rearmost portion of base support 44 of front handle member 12. Once rear handle member 14 is in this position, the two handles 12*a* and 14*a* of front handle member 12 and rear handle member 14, respectively, can be squeezed together, as described above. As handles 12*a* and 14*a* are either squeezed together, or are allowed to be separated, front and rear handle members 12 and 14 tend to pivot around a point near the rearmost portion of base support 44. In this configuration, the squeezing together of the handles 12a and 14a tends to force a portion of highly viscous fluid material from the tip 24 of the decreasing diameter nozzle 18. In addition, the separation apart of handles 12a and 14a from one another tend to open gap 30 somewhat, so that collapsible tube 16 can either be removed from the gap 30, or so that collapsible tube 16 can be moved further into gap 30, after which time a different portion of collapsible tube 16 could be squeezed by engaging plates 32 and 40 (of front and rear handle members 12 and 14). It will be understood that gap 30 is the space remaining of slot 50 once the engaging plate 32 of rear handle member 14 has been inserted through slot 50.

Figure 9:
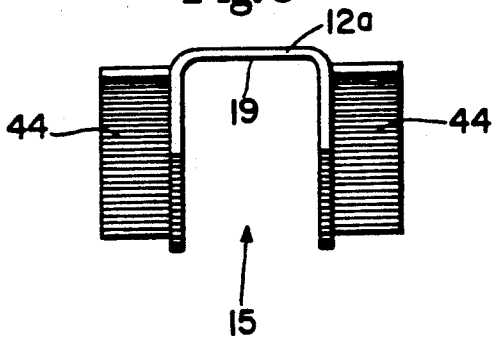
FIG. 9 is a bottom plan view of the bottom portion of the front handle member for the collapsible tube dispenser apparatus of FIG. 1.

FIG. 9 depicts the bottom portion of front handle 12a. In the illustrated embodiment, front handle 12a is channel-shaped in form.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention by defined by the claims appended hereto.

I claim:

1. An apparatus adapted for use with a collapsible tube having a fluid material as its contents, said collapsible tube having elongated sides, a first end which is closed, and a second end which has an opening of predetermined size, the apparatus comprising:

(a) a first handle, said first handle comprising:

(i) a first elongated member of sufficient width and thickness to fit within the palm of an adult hand, said first elongated member having a first and second end;

(ii) a planar first engaging plate integrally connected to the first end of said first elongated member, said first engaging plate having its planar surface substantially perpendicular to the axial direction of said first elongated member, said first engaging plate having sufficient width to exceed the width of said collapsible tube at the collapsible tube's first end, said first engaging plate having sufficient length so that it can make physical contact with a large enough portion of an elongated side of said collapsible tube so as to be able to force a portion at least of the collapsible tube's contents from its open second end;

(b) a second handle, said second handle comprising:

(i) a second elongated member of sufficient width and thickness to be gripped by the fingers of an adult hand, said second elongated member having a first and second end;

(ii) members for limiting the travel of said first engaging plate when the apparatus is in the configuration wherein the second end of said first elongated member is in distal relationship with the second end of said second elongated member;

(iii) a planar second engaging plate having its planar surface substantially perpendicular to the axial direction of said second elongated member, said second engaging plate having sufficient width to exceed the width of said collapsible tube at the collapsible tube's first end, said second engaging plate having sufficient length so that it can make physical contact with a large enough portion of an elongated side of said collapsible tube so as to be able to force the collapsible tube's contents from its open second end;

(iv) means for supporting said second engaging plate such that the second engaging plate correctly provides a means for limiting the travel of said first engaging plate when the apparatus is in the configuration wherein the second end of said first elongated member is in proximal relationship with the second end of said second elongated member; and (c) a clearance slot formed between said second engaging plate and said means for limiting travel of the first engaging plate at a location wherein the second engaging plate and the means for limiting travel of the first engaging plate are in proximal relationship to one another, said clearance slot having sufficient size to allow the through placement of said first engaging plate therein, said clearance slot additionally having sufficient size to allow the through placement of the first end of said collapsible tube therein.

2. An apparatus as recited in claim 1, wherein said planar first engaging plate has bent corners at locations proximal to said clearance slot, said bent corners providing means for properly positioning said first handle with respect to said second handle.

3. An apparatus as recited in claim 1, wherein the second elongated member of said second handle has a clearance notch cut out along the second elongated member's length at a position proximal to said means for limiting the travel of said first engaging plate, and further comprising a gusset support which is integrally connected to the first elongated member of said first handle and is also integrally connected to the first engaging plate of said first handle.

4. An apparatus as recited in claim 1, wherein said means for supporting said second engaging plate including at least one first edge and at least one second edge, said first and second edges substantially defining two sides of a triangle.

5. An apparatus as recited in claim 1, wherein the second elongated member of said second handle is channel-shaped in form, said second elongated member having an open side, and wherein the first elongated member of said first handle is small enough in width to be placed within the confines of the open side of said second elongated member.

6. An apparatus adapted for use with a collapsible tube having a fluid material as its contents, said collapsible tube having elongated sides, a first end which is closed, and a second end which has an opening of predetermined size, the apparatus comprising:

(a) a first handle, said first handle comprising:

(i) a first elongated member of sufficient width and thickness to fit within the palm of an adult hand, said first elongated member having a first and second end;

(ii) a planar first engaging plate integrally connected to the first end of said first elongated member, said first engaging plate having its planar surface substantially perpendicular to the axial direction of said first elongated member, said first engaging plate having sufficient width to exceed the width of said collapsible tube at the collapsible tube's first end, said first engaging plate having sufficient length so that it can make physical contact with a large enough portion of an elongated side of said collapsible tube so as to be able to force a portion at least of the collapsible tube's contents from its open second end;

(b) a second handle, said second handle comprising:

(i) a second elongated member of sufficient width and thickness to be gripped by the fingers of an adult hand, said second elongated member having a first and second end;

(ii) at least one base support integrally connected to the first end of said second elongated member, said base support providing a means for limiting the travel of said first engaging plate when the apparatus is in the configuration wherein the second end of said first elongated member is in distal relationship with the second end of said second elongated member;

(iii) at least one upright support, said upright support having a first edge which is integrally connected to said base support, said upright support also having a second edge;

(iv) a planar second engaging plate integrally connected to the second edge of said upright support, said second engaging plate having its planar surface substantially perpendicular to the axial direction of said second elongated member, said second engaging plate having sufficient width to exceed the width of said collapsible tube at the collapsible tube's first end, said second engaging plate having sufficient length so that it can make physical contact with a large enough portion of an elongated side of said collapsible tube so as to be able to force the collapsible tube's contents from its open second end, the second engaging plate also being correctly positioned for providing a means for limiting the travel of said first engaging plate when the apparatus is in the configuration wherein the second end of said first elongated member is in proximal relationship with the second end of said second elongated member;

(c) a clearance slot formed between said second engaging plate and said base support at a location wherein the second engaging plate and the base support are in proximal relationship to one another, said clearance slot having sufficient size to allow the through placement of said first engaging plate therein; and (d) a clearance gap formed between said first engaging plate and said second engaging plate at a location proximal to said clearance slot, said clearance gap having sufficient size to allow the through placement of the first end of said collpaisble tube therein.

7. An apparatus as recited in claim 6, wherein said planar first engaging plate has bent corners at locations proximal to said clearance gap, said bent corners providing means for properly positioning said first handle with respect to said second handle.

8. An apparatus as recited in claim 6, wherein the second elongated member of said second handle has a clearance notch cut out along the second elongated member's length at a position proximal to said base support, and further comprising a gusset support which is integrally connected to the first elongated member of said first handle and is also integrally connected to the first engaging plate of said first handle.

9. An apparatus as recited in claim 6, wherein the first and second edges of said upright support substantially define two sides of a triangle.

10. An apparatus as recited in claim 6, wherein the second elongated member of said second handle is channel-shaped in form, said second elongated member having an open side, and wherein the first elongated member of said first handle is small enough in width to be placed within the confines of the open side of said second elongated member.

11. An apparatus adapted for use with an elongated collapsible tube having a fluid material as its contents, said collapsible tube having upper and lower surfaces, a first rear end which is closed, and a second front end which has an opening for dispensing the fluid therefrom when said tube surfaces are squeezed together, the apparatus comprising:

(a) a first handle, said first handle comprising:

(i) a first elongated member dimensioned to be grasped by an adult hand, said first elongated member having upper and lower ends;

(ii) a first engaging plate fixedly connected to the upper end of said first elongated member, said first engaging plate being configured to abut and press against the lower surface of the collapsible tube, the rearmost portion of said first engaging plate defining a first pivot point;

(b) a second handle separate and distinct from said first handle, said second handle comprising:

(i) a second elongated member dimensioned to be grasped by an adult hand, said second elongated member having upper and lower ends;

(ii) a second engaging plate fixedly connected to the upper end of said second elongated member, said second engaging plate being configured to abut and press against the upper surface of the tube, the rearmost portion of said second engaging plate defining a second pivot point; and (c) said first and second pivot points lying in abutting pivotable relationship when said handles are brought together in their operable positions so that said handles are pivotable about said pivot points and so that said first and second engaging members are in spaced graspable relationship and a portion at least of the lower and upper surfaces of the collapsible tube is positioned between said first and second engaging plates, respectively, said first and second engaging plates operating to approach each other and thereby press the collapsible tube therebetween as said first and second elongated members are squeezed together.

12. An apparatus as recited in claim 11, including means for preventing the displacement of the collapsible tube from the apparatus as the elongated members are squeezed together.

13. An apparatus as recited in claim 12, wherein said collapsible tube displacement preventing means comprises a gap formed between the rearmost edges of said engaging plates and dimensioned to allow the rearmost portion of the collapsible tube to pass therethrough, said rearmost edges of the engaging plates contacting and retaining the sides of the collapsible tube.

* * * * *

UNITED STATES PATENT AND TRADEMARK OFFICE

CERTIFICATE OF CORRECTION

PATENT NO. : 5,199,611

DATED : April 6, 1993

INVENTOR(S) : Richard A. Santefort, Ray H. Haerr

It is certified that error appears in the above—identified patent and that said Letters Patent is hereby corrected as shown below:

Claim 1, column 9, line 59, delete "members" and insert --means--.

Claim 4, column 10, line 42, delete "including" and insert --include--.

Claim 6, column 11, line 56, delete "collpaisble" and insert therefor --collapsible--.

Signed and Sealed this

Twenty-eighth Day of December, 1993

*Attest:*

*Attesting Officer*

BRUCE LEHMAN

*Commissioner of Patents and Trademarks*